US006012774A

United States Patent [19]

Potter

[11] Patent Number: 6,012,774

[45] Date of Patent: Jan. 11, 2000

[54] RECLINING CHAIR WITH GUIDE RAIL SYSTEM

[75] Inventor: David Potter, Los Angeles, Calif.

[73] Assignee: HWE, Inc., Long Beach, Calif.

[21] Appl. No.: 09/173,932

[22] Filed: Oct. 16, 1998

Related U.S. Application Data

[63] Continuation of application No. 08/751,914, Nov. 18, 1996.

[51] Int. Cl.[7] ..... A47C 1/02

[52] U.S. Cl. ..... 297/325; 297/261.3; 297/329

[58] Field of Search ..... 297/256.13, 258.1, 297/261.1, 261.2, 261.3, 269.1, 325, 329; 248/430; 312/334.15, 334.16, 334.18, 334.26

[56] References Cited

U.S. PATENT DOCUMENTS

| | | | |
|---|---|---|---|
| 93,660 | 8/1869 | Theaker . | |
| D. 292,350 | 10/1987 | Goldman | D6/361 |
| 825,984 | 7/1906 | Schmersahl . | |
| 2,153,763 | 4/1939 | Kuhler | 155/116 |
| 2,919,745 | 1/1960 | Schliephacke | 297/329 X |
| 3,235,304 | 2/1966 | Glass | 297/19 |
| 4,092,041 | 5/1978 | Landry et al. | 297/68 |
| 4,101,168 | 7/1978 | Ferro | 297/250 |
| 4,348,048 | 9/1982 | Thévenot | 297/329 |
| 4,383,714 | 5/1983 | Ishida | 297/325 |
| 4,790,599 | 12/1988 | Goldman | 297/327 |
| 4,941,709 | 7/1990 | Möller | 297/325 |
| 4,957,302 | 9/1990 | Maxwell | 280/32.6 |
| 5,441,129 | 8/1995 | Porter et al. | 188/67 |
| 5,507,562 | 4/1996 | Wieland | 297/423.2 |
| 5,624,159 | 4/1997 | Celoni et al. | 297/325 |

FOREIGN PATENT DOCUMENTS

| | | | |
|---|---|---|---|
| 526911 | 3/1954 | Belgium . | |
| 189915 | 8/1986 | European Pat. Off. | 297/329 |
| 931519 | 6/1982 | U.S.S.R. | 297/318 |

OTHER PUBLICATIONS

Advertising brochure distributed by Relax The Back Store regarding pendulum based reclining chair (2 pp).

Excerpt from catalog distributed by Atelier International (AI) regarding Le Corbusier LC/4 Chaise Lounge and schematic drawing of same (2 pp).

*Primary Examiner*—Peter R. Brown
*Attorney, Agent, or Firm*—Christie, Parker & Hale, LLP

[57] ABSTRACT

A reclining chair has a seat structure for supporting a an occupant, a free-standing support assembly for supporting the seat structure, a guided rail system connected to the seat structure and support assembly for allowing an occupant to recline in the seat structure in various positions, and a brake assembly for inhibiting movement of the seat structure. The seat structure includes a frame contoured to comfortably support the occupant. The support assembly includes first and second side members. The guide rail system includes a pair of semi-circular tubular rail members, one rail member connected to opposite sides of the frame, and one or more guide elements mounted to the side members. The frame rotates as the rail members slide through the rail guide brackets, thereby reclining the chair. A preferred brake assembly includes at least one lever actuated brake shoe which engages the rail member, creating sufficient friction to inhibit movement of the rail member through the guide elements, thereby fixing the seat structure and occupant the desired reclining position. An alternate brake assembly inhibits movement of the seat portion through the use of a switch activated linear locking mechanism.

24 Claims, 11 Drawing Sheets

32
20
26
10
18
40
30
36
38
12
48
56
78
52
54
74
50
76
44
46
24
35
34
72
14
42

RECLINING CHAIR WITH GUIDE RAIL SYSTEM

CROSS REFERENCE TO RELATED APPLICATION

This application is a continuation of patent application Ser. No. 08/751,914; filed Nov. 18, 1996.

FIELD OF THE INVENTION

The present invention relates generally to chairs, and more particularly to a reclining chair incorporating a novel guide rail system. The system includes rail members movably mounted in one or more guide elements for connecting the seat structure of the chair to its support assembly, and for allowing an occupant to recline the chair in various positions.

BACKGROUND

Numerous recliners have been available for some time that allow a person to lean back in the chair or engage in a rocking motion to relax. More recently, reclining chairs have been developed that allow a person's feet to be elevated above his or her heart for relaxation and therapeutic purposes. One such chair, called a chaise longue, is designed by Le Corbusier. That chair includes a seat portion and supporting legs. The supporting legs include long, arc-shaped, formed steel tubes adapted for cradling the seat portion. The seat portion is held in place on the supporting legs merely by friction applied by the weight of the occupant. Because it relies on the occupant's weight as a braking mechanism, one disadvantage of the chair is that the occupant must get off of it to recline to a different position, which can be inconvenient.

Another reclining chair that allows for a user's feet to be elevated above his or her heart is disclosed in Goldman, U.S. Pat. No. 4,790,599 ("Goldman"). That chair includes a fixed seat structure and a supporting frame having oppositely positioned side members. The seat structure swings or pivots about pivot connecting points on each of the side members by way of pivot elements resembling pendulum arms. The pendulum arms extend from the pivot point to a corresponding end of the seat structure. Accordingly, the combined weight of the occupant and seat structure is supported directly from the pivot point.

Although suitable for allowing the chair to be reclined, the chair disclosed in Goldman also possesses undesirable characteristics. One disadvantage is that its pendulum arms constrain the types of designs that can be realized because the pendulum arms cannot be obstructed. Another disadvantage has to do with the chair's braking system for locking the seat structure into a particular position. The braking system includes a pair of rotatable knobs, one coupled to each pendulum arm opposite the pivot point. When screwed, each knob frictionally engages the outside of an arc-shaped, slotted guide track on each side member arranged to follow the motion of the pendulum arm. To lock the chair in a particular position, the user must turn the knobs in opposite directions, which can be awkward.

Users of reclining chairs and those skilled in the art of designing such chairs would prefer a reclining chair in which an individual could easily recline and place his or her feet above the heart, but which is not limited in the types of designs that can be used to construct the chair. In addition, they would desire an improved braking system that does not require the occupant to get off of the chair and does not require awkward hand movement to lock the chair in a particular position.

SUMMARY

There is therefore provided in accordance with the present invention a reclining chair with a novel guide rail system. The chair includes a seat structure for supporting an occupant and a support assembly including leg assemblies or side members for supporting the seat structure. To allow an occupant to recline in the chair in an infinite range of positions between an upright position and a fully reclined position in which the user's feet are above his or her heart, the seat structure is coupled to the support assembly by way of a guide rail system which enables movement of the seat structure relative to the support assembly. The system includes a pair of rail members in a fixed, positional relationship to one another and corresponding guide elements adapted for supporting and movably engaging the rail members. Because this chair has no pendulum arm or pivot element extending from a pivot point to the seat structure, a designer does not have to be concerned with leaving the arm unobstructed.

To hold the seat in a particular position, a brake assembly is provided to enable the occupant to fix the chair's reclining position by inhibiting movement of the seat structure relative to the support assembly. In a preferred embodiment, the brake assembly includes a lever actuated brake shoe which frictionally engages one of the rail members and curtails its movement. With this brake assembly, the occupant can lock the chair into place without exiting the chair and without having to engage in awkward hand movement.

BRIEF DESCRIPTION OF THE DRAWINGS

Other objects, features and advantages of the invention will appear from the following description of a preferred embodiment, taken together with the drawings in which.

DETAILED DESCRIPTION OF THE PREFERRED EMBODIMENT

Figure 1:
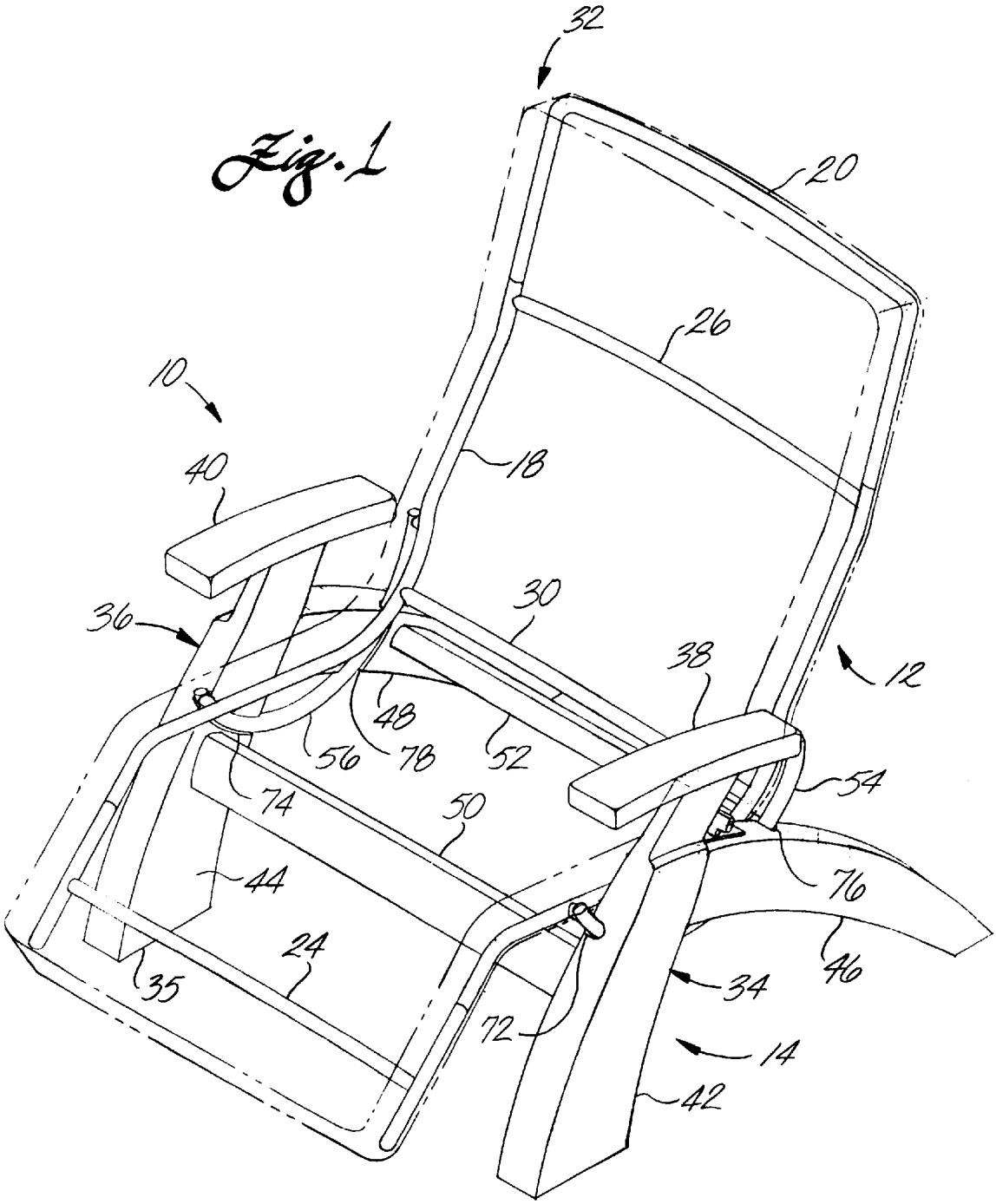
FIG. 1 is a perspective view, partly in phantom, of the reclining chair according to the present invention.
Figure 2:
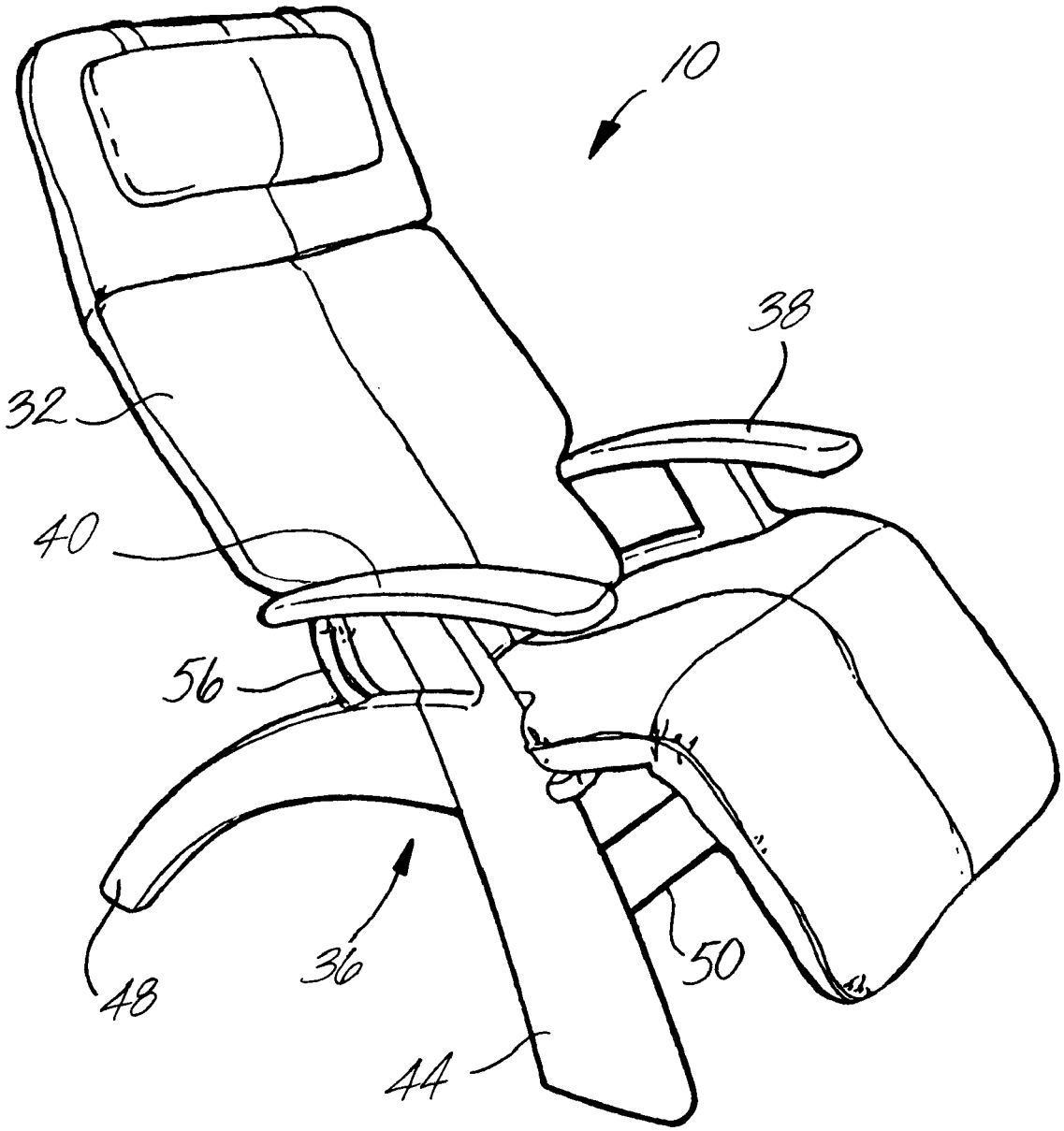
FIG. 2 is another perspective view of the reclining chair according to the present invention.

Referring to FIGS. 1 and 2, the reclining chair 10 according to the present invention generally includes a seat structure 12 contoured to accommodate an occupant, a support assembly 14 for supporting the seat structure, and a guide rail system 16 (FIGS. 3–5) for coupling the seat structure to the support assembly and for enabling the occupant to recline the chair in various positions. The seat structure includes a body frame 18 and a header frame 20 coupled telescopically to the upper end of the body frame. For added stability, bow braces 24, 26 and bow spanner 30 are welded to the left and right sides of the body frame. The parts of the frames are preferably constructed from steel tubing or other rigid material cut and bent to the appropriate size and shape. For added comfort, the seat structure is preferably encased in upholstery 32, such as leather, fabric, vinyl or any other suitable material. Although illustrated in a particular shape and style, the seat structure may be designed in any number of different ways.

The support assembly 14 includes left and right leg assemblies 34, 36 (also referred to as side members) and corresponding left and right arm cores 38, 40. The leg assemblies include upwardly angled front stanchions 42, 44, each having an upper end and a lower end, and downwardly curved rear braces 46, 48, each connected to the corresponding stanchion intermediate the upper and lower ends. The left and right arm cores are attached to the upper ends of the corresponding stanchions, and are positioned to function as arm rests for the occupant. In a preferred embodiment, the leg assemblies are constructed of cast aluminum, wood, or any other suitable material capable of supporting the combined weight of the seat structure and the occupant, and the arm cores are made of blow molded polyethylene plastic, wood, or any other suitable material.

To further stabilize the support assembly, a front beam 50 is positioned horizontally between the stanchions and attached to the inner surface of each stanchion. In a similar manner, a rear beam 52 is positioned horizontally between the two rear braces and attached to the inner surface of each brace. The beams are made out of extruded aluminum, wood or any other suitable material. Although described in a preferred embodiment as the combination of front stanchions and rear braces, the leg assemblies can be designed in any number of ways for providing a stable and free-standing structure.

Figure 3:
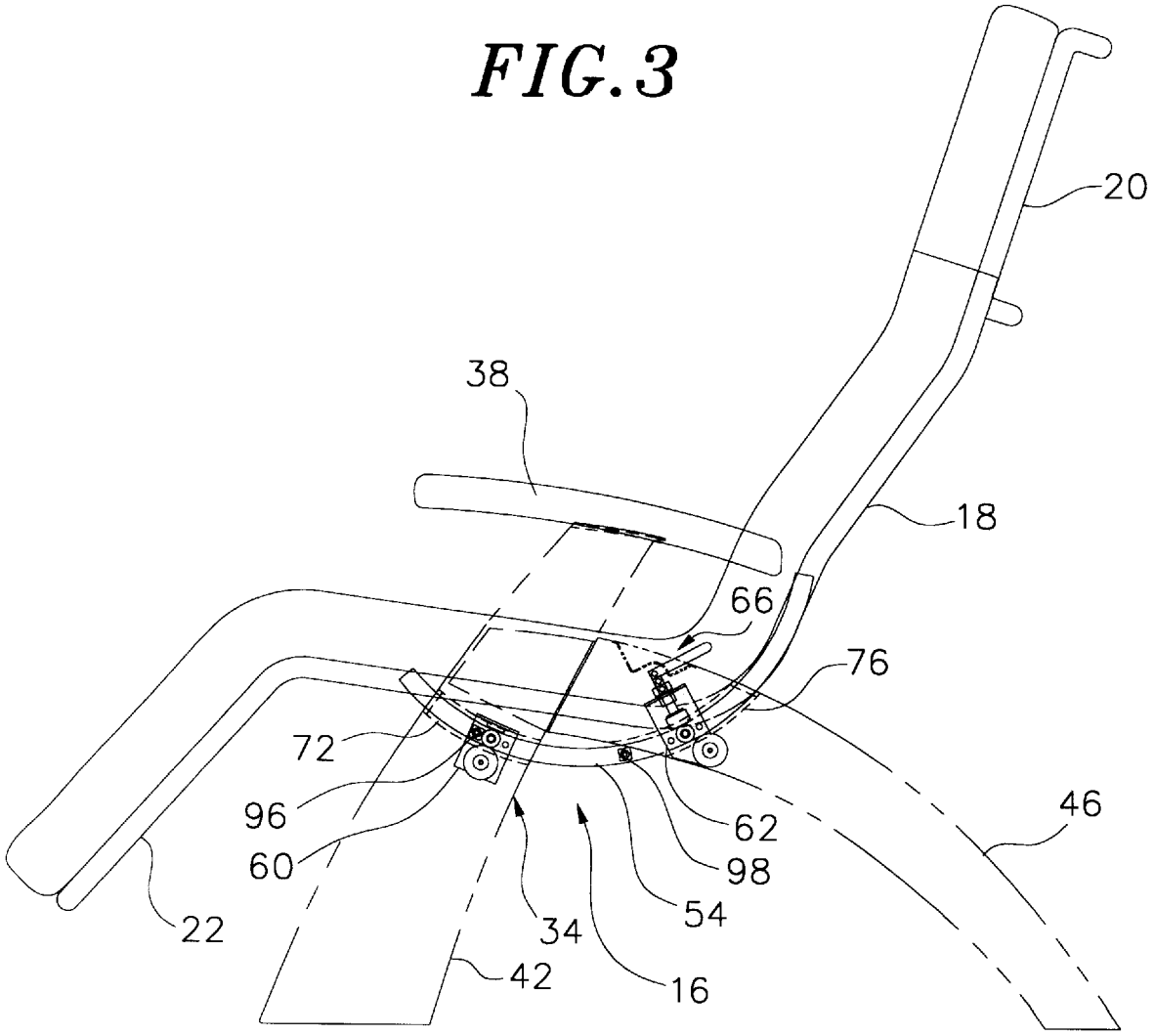
FIG. 3 is a side view, partly in phantom, of the chair in an upright position.
Figure 4:
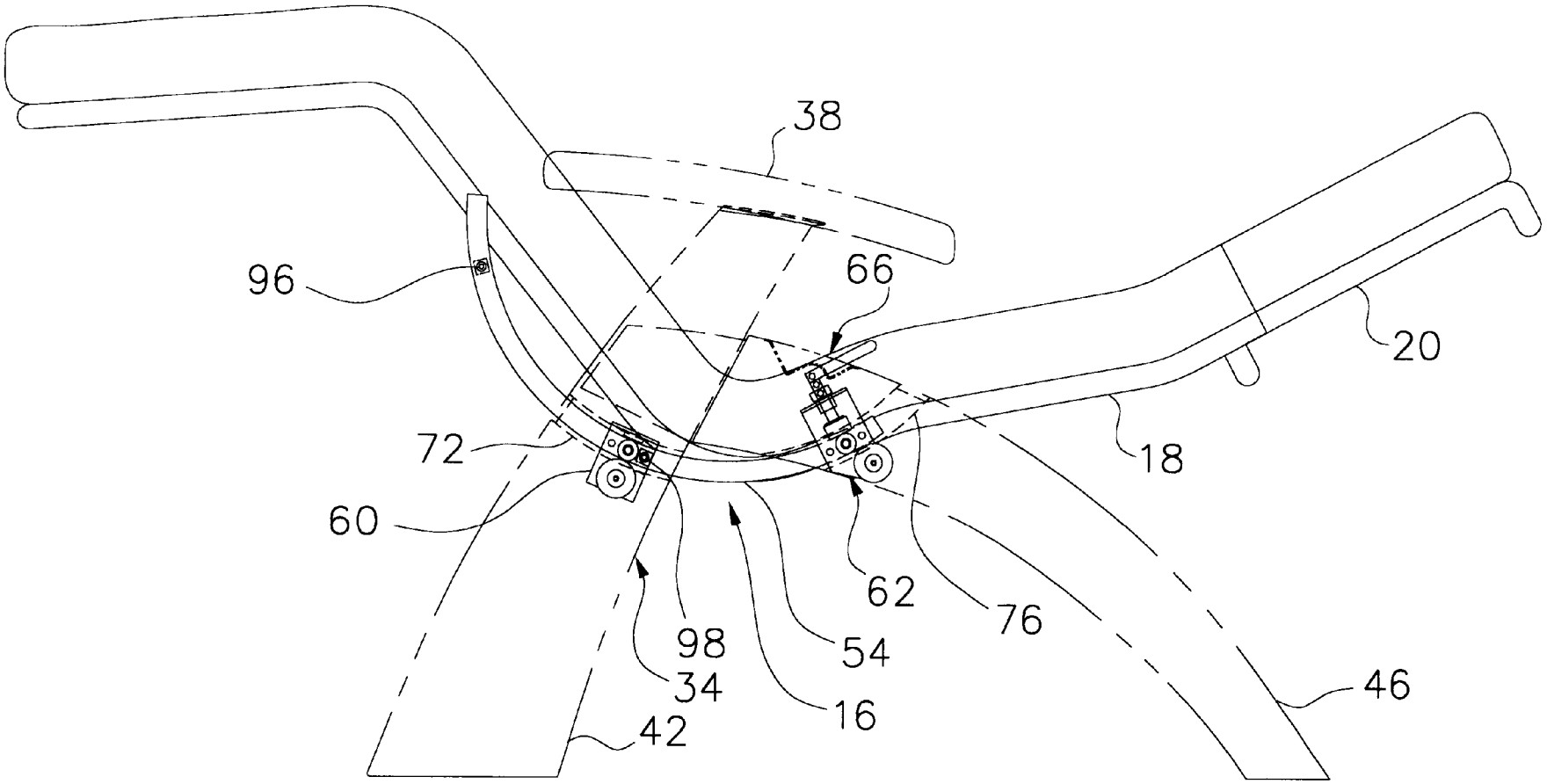
FIG. 4 is a side view, partly in phantom, of the chair in a fully reclined position.
Figure 5:
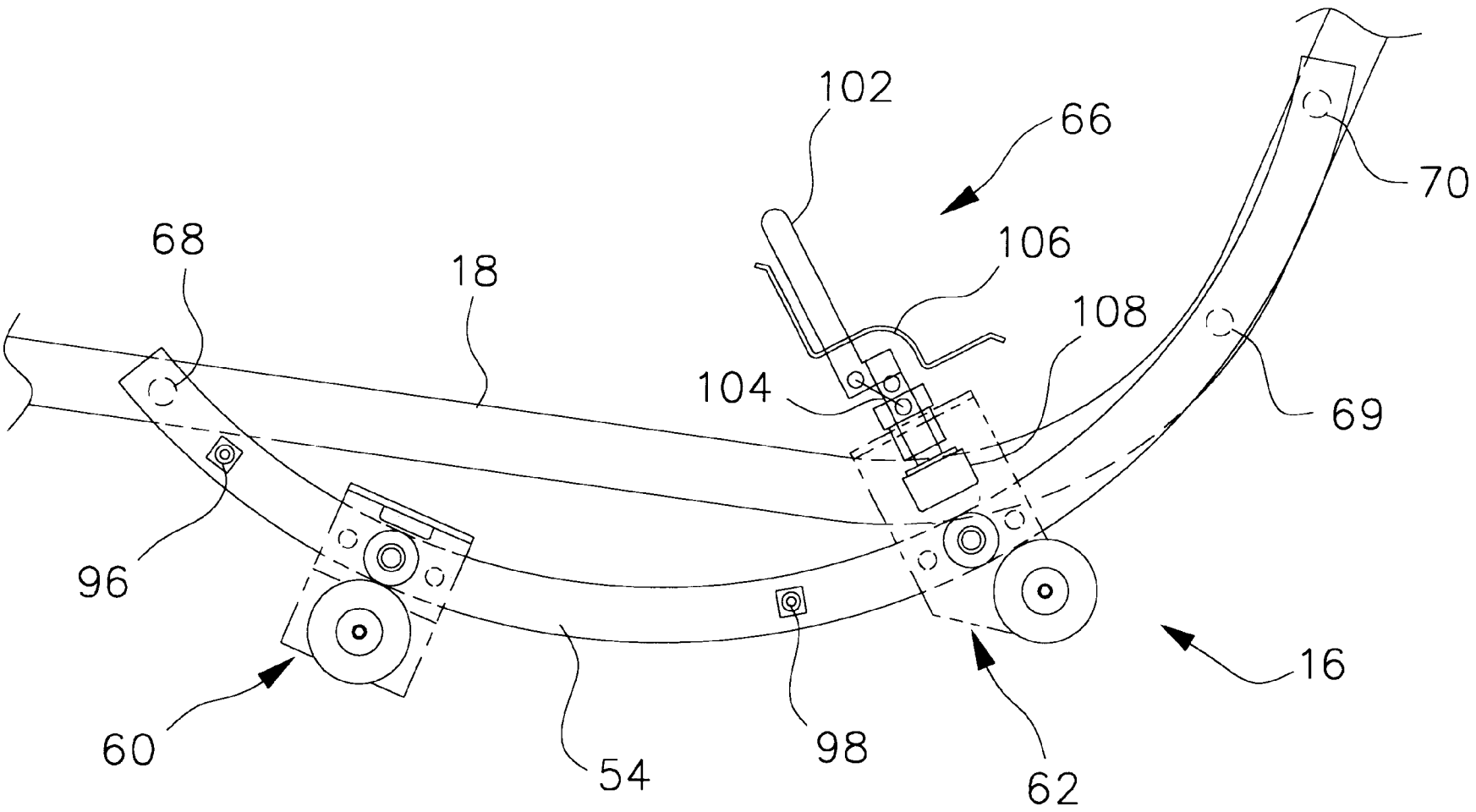
FIG. 5 is a side view, partly in phantom, of a presently preferred embodiment of the guide rail system according to the present invention.

Referring to FIGS. 3–5, the guide rail system 16 enables the occupant to recline in an infinite range of positions between a fully upright and a fully reclined position. In FIG. 3, the chair is shown in an upright position in which an occupant can readily enter or exit the chair. In FIG. 4, the chair is shown in a reclined position in which the occupant's feet can be placed above his or her heart for relaxation or therapeutic purposes.

Figure 7A:
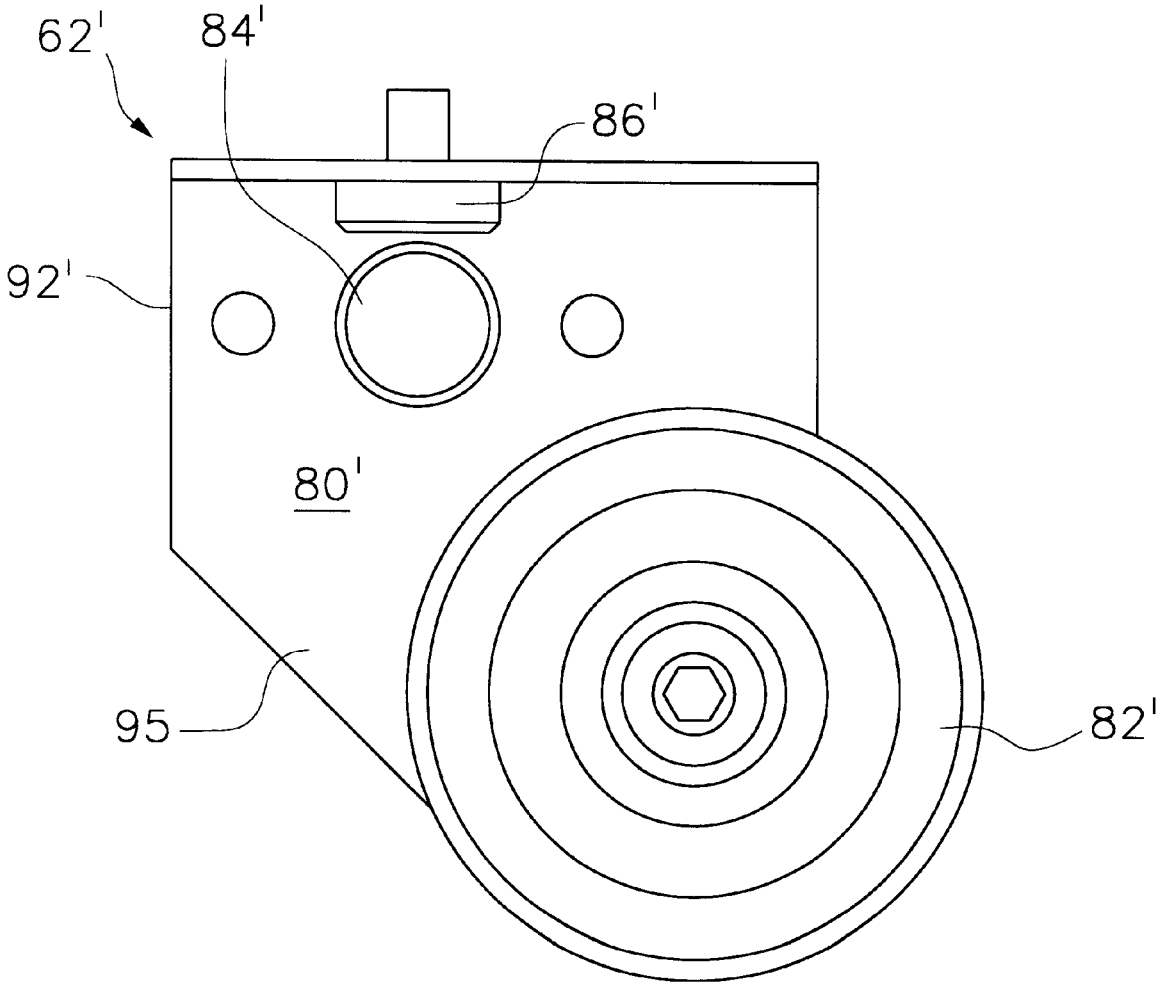
FIGS. 7*a* and 7*b* are a side view and a front view, respectively, of an exemplary rear guide element used in the system of FIG. 5.
Figure 7B:
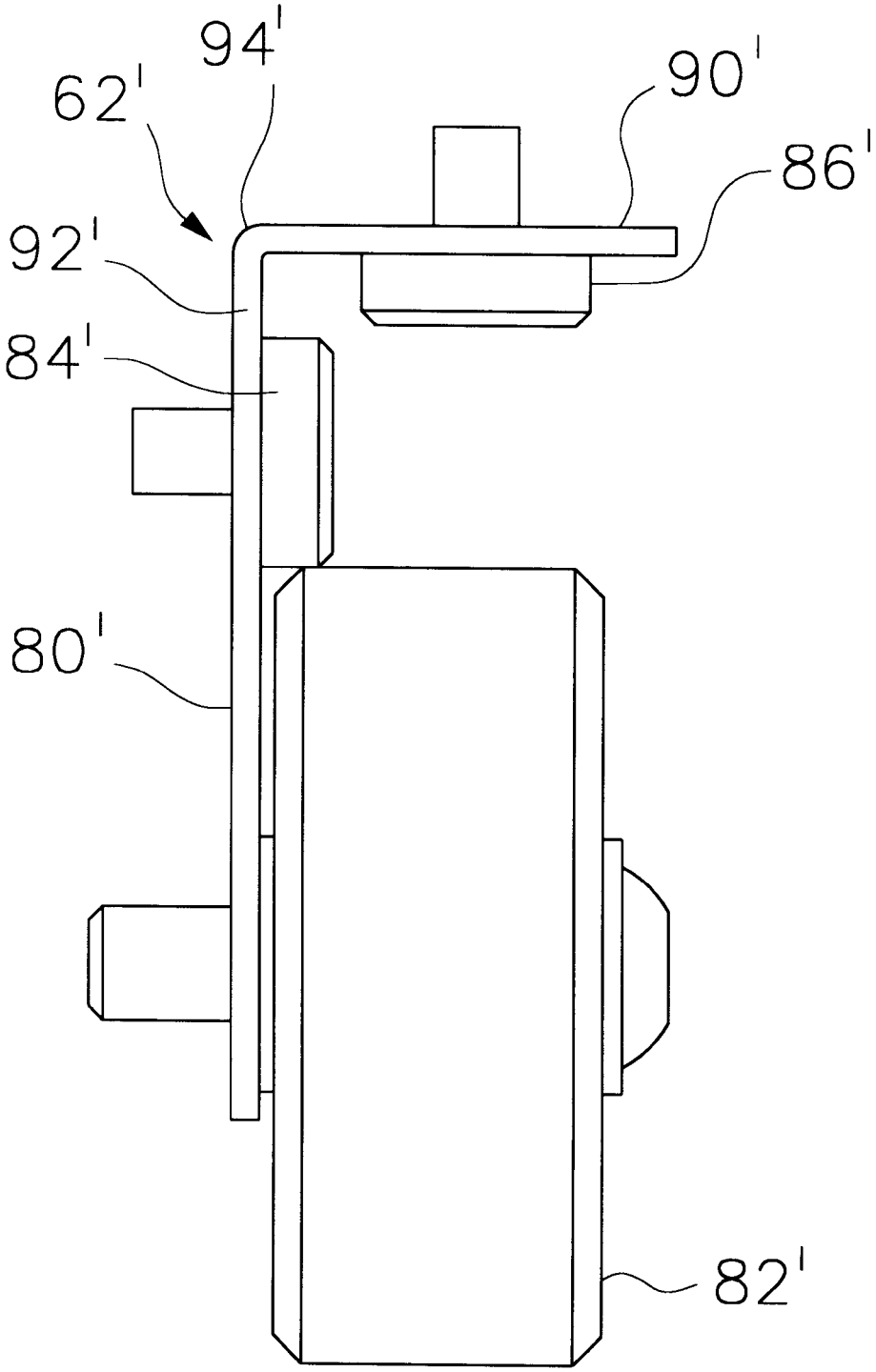

The guide rail system includes a pair of substantially similar left and right rail members 54, 56 (FIG. 1) arranged in a fixed, positional relationship to each another. The rail members are each movably supported by a front guide element 60 and one of two types of rear guide elements 62, 62' (FIGS. 7*a* and 7*b*). As shown in FIGS. 3–5 and in more detail in FIG. 8, the left rear guide element 62 is integrated with a brake assembly 66 in the preferred embodiment. The rail member 56 (FIG. 1) and guide elements for the right side of the chair are substantially similar to those used on the left side, except that as shown in FIGS. 7*a* and 7*b*, there is no brake assembly associated with the right rear guide element 62' in the preferred embodiment.

In a preferred embodiment, the rail members are semi-circular tubular members mechanically fastened to the exterior sides of the body frame 18 through standoffs 68, 69, 70 (FIG. 5) formed on the inside surface of each rail member and bolted to the body frame. The front guide elements are attached to the front stanchions within curved channels 72, 74 (shown in FIG. 1 and in phantom in FIGS. 3 and 4) preferably precut into the inside surfaces of the stanchions and configured to allow for unhindered movement of the rails. In a similar manner, the rear guide elements are preferably attached within curved channels 76, 78 precut within the inside surfaces of the rear braces. The guide elements are positioned at an appropriate angle to accommodate the movement of the semi-circular rail.

In use, the occupant sitting in the chair merely has to tilt backwards to recline. As he or she does so, the rail members slide through the guide elements and the seat structure rotates. The top of the header frame 20 rotates in substantially a downward arc and the bottom of the body frame 22 rotates in substantially an upward arc. In the preferred embodiment, it will readily be appreciated that the combined weight of the seat structure and any occupant is directly supported at the points at which the rail members engage the guide elements.

Figure 6A:
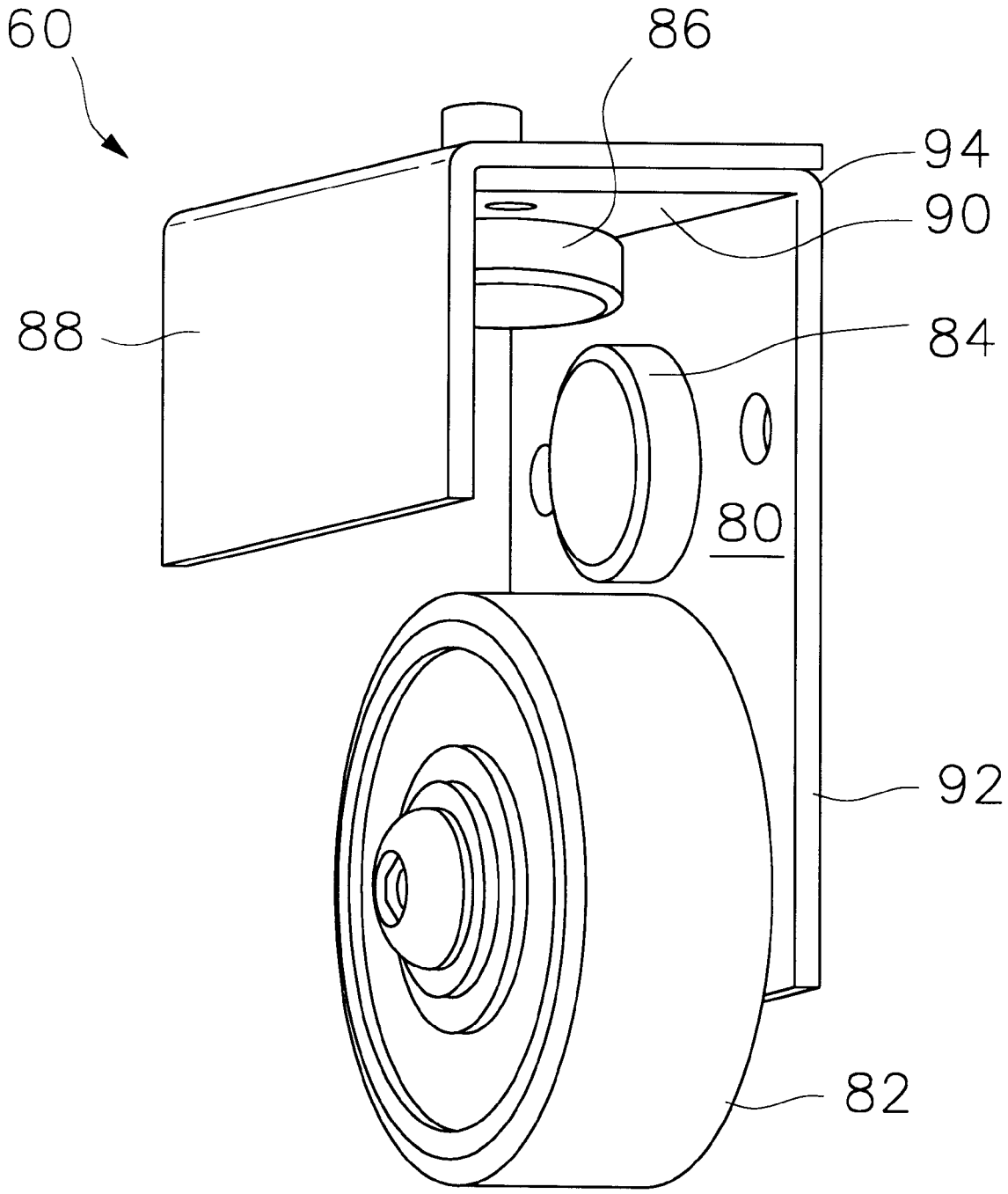
FIGS. 6*a* and 6*b* are a perspective view and a front view, respectively, of an exemplary front guide element used in the guide rail system of FIG. 5.
Figure 6B:
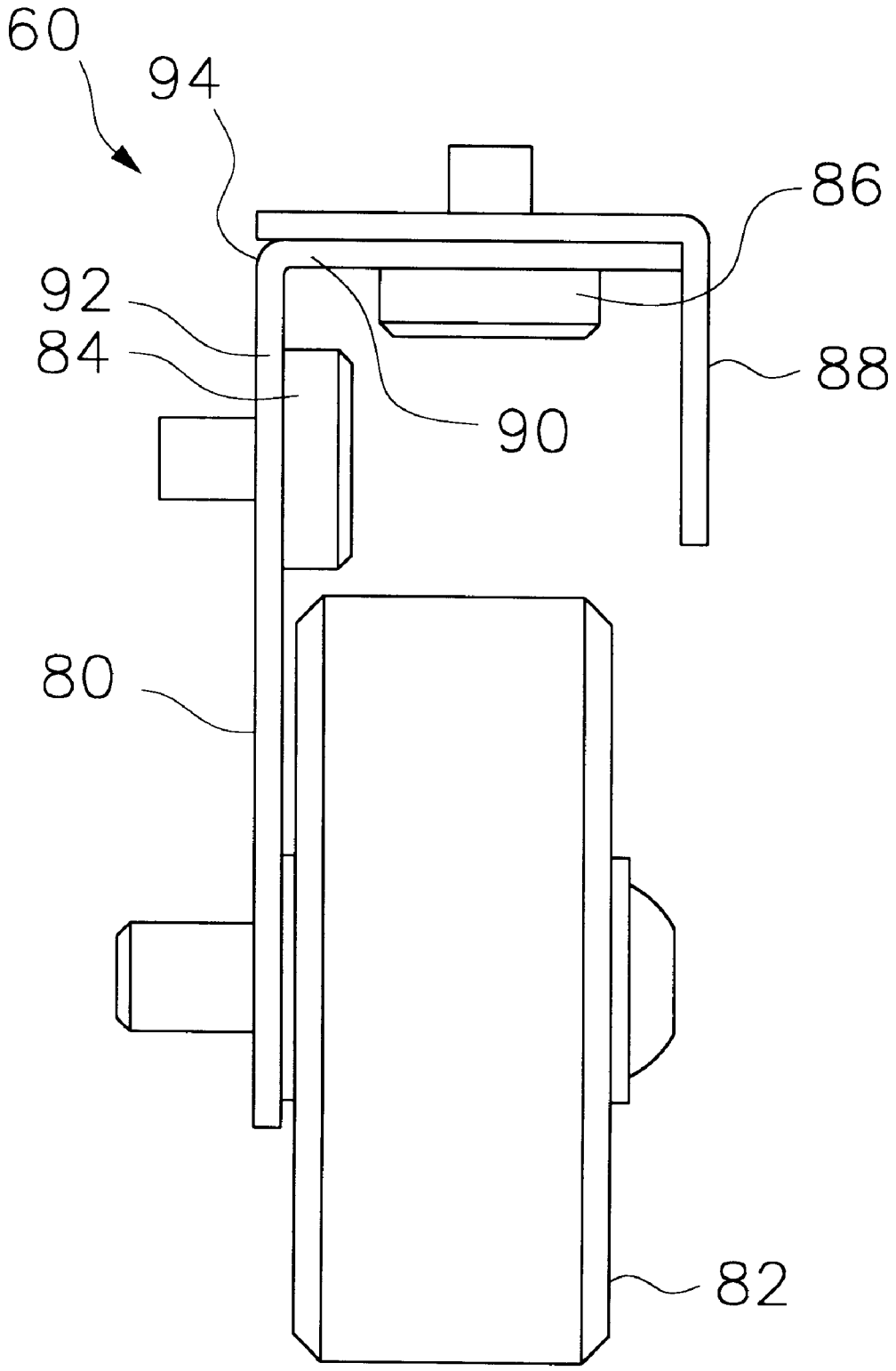

Referring to FIGS. 6*a* and 6*b*, in a preferred embodiment, exemplary front guide element 60 includes bracket 80, roller 82, side and top bumpers 84, 86, and stop flange 88. The bracket includes an arm 90 and a leg 92 extending outwardly from a bend 94 at right angles to one another. In the illustrated embodiment, the roller has a two inch diameter and is rotatably coupled to the inside surface of the leg opposite the bend. Side bumper 84 is also affixed to the inside surface of the leg between the roller and the bend, and top bumper 86 is affixed to the inside surface of the arm directly above the roller. The bumpers are preferably made of nylon or are covered by a nylon sheath to allow the rail members to slide against the bumpers. The roller and its connection to the leg should be sufficiently strong to bear the combined load of the seat structure and an occupant.

The left rear guide element 62 (FIG. 8) is similar to the right rear guide element 62' (FIGS. 7*a* and 7*b*), except that the left rear guide element is integrated with the brake assembly 66. Like reference numerals are used for both rear elements. The rear elements are similar in structure to the front guide element 60 except that the rear guide elements have a leg extension member 95 and no stop flange. The leg extension member extends at an angle from the lower end of leg 92' enabling the rear guide elements to be mounted on the rear braces as shown in FIGS. 3–5.

Figure 8:
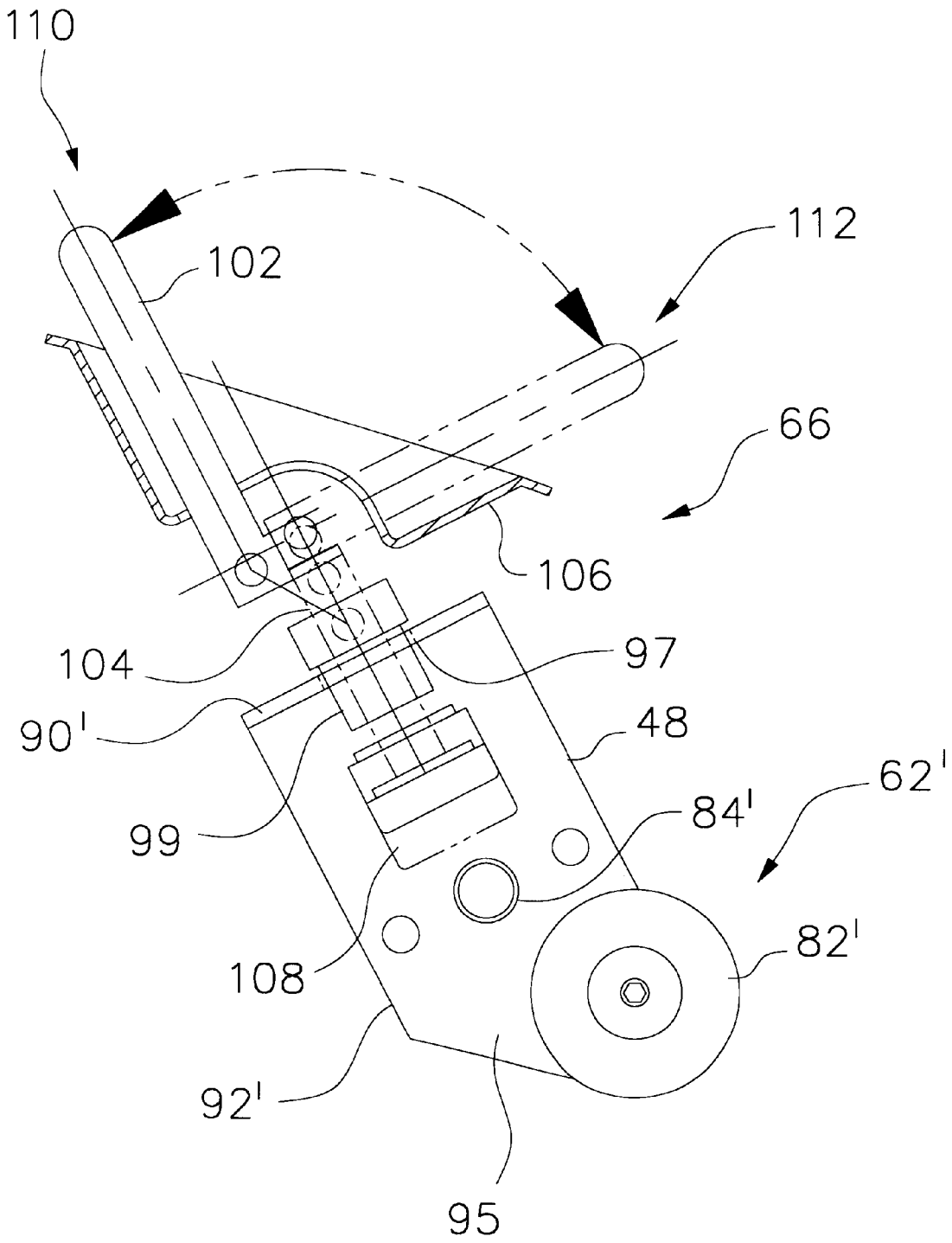
FIG. 8 is a side view of the presently preferred lever actuated brake assembly according to the present invention.

As shown in FIGS. 7*a* and 7*b*, the right rear guide element 62' includes bracket 80', roller 82', and side and top bumpers 84', 86' connected to bracket leg 92' and bracket arm 90' respectively. As shown in FIG. 8, the left rear guide element 62 has an extended leg 92' and an arm 90' having a slot 97 adapted to accommodate the brake shaft 99. Although described as being constructed from brackets having arms and legs, the guide elements may be constructed in a variety of different ways. For example, the brackets may be constructed in numerous different shapes and sizes, and various rolling and/or sliding members may be used. Accordingly, the guide elements may include curved brackets adapted to support bearings or other rolling or sliding members.

Referring again to FIGS. 3–5, rotation of the chair is limited between the upright and fully reclined positions by a front rail stop 96 and a rear rail stop 98 preferably positioned on each of the rail members 28, 30. The rail stops are welded, bolted or attached by any other suitable means to the outside surface of the rails. As shown in FIG. 3, the front rail stop 96 is positioned to engage the front roller 82 and prevent the chair from rotating upward past the point at which the header frame 20 is substantially upright. In the chair's upright position, the user can easily sit down on or stand up from the chair. Conversely, as shown in FIG. 4, in the chair's reclined position, the rear rail stop 98 engages the other side of the front roller, thereby limiting the chair from moving past the fully reclined position.

In the preferred embodiment, the rail stops are formed of a medium density elastomeric sheath made from injection molded HYTREL brand polyester elastomer marketed by Du Pont Company, Wilmington, Del. This material is presently preferred because it is durable and capable of withstanding repeated impact. Although shown in particular positions on the rail members, the rail stops may be moved to facilitate entry to and exit from the chair. For example, it may be desirable to move the front rail stop closer to the front end of the rail member so the frame can rotate in a forward direction beyond the upright position, thereby allowing a user to conveniently sit in or get out of the chair. Similarly, the rear rail stop can be moved further back along the rail to allow for a different fully reclined position. In alternate embodiments, the rail stops can also be formed in a number of different ways to limit movement of the rail members. For example, the rail stops can be pins partially inserted in slots in the rail member.

Referring to FIGS. 5 and 8, brake assembly 66 provides a user with a control mechanism for fixing a desired location of the seat portion between the upright and reclined positions. In a preferred embodiment, the brake assembly is located between the left rear brace 46 and the body frame 18 adjacent the left rail member 54 (FIGS. 3 and 4), and is integrated with the left rear guide element 62. Through actuation of a mechanical lever 102 from an up position 110 to a down position 112, the occupant can frictionally lock movement of the rail. The lever is contained within an aluminum housing 106 or a slot positioned within the left rear brace near the front left stanchion 42 (FIGS. 3 and 4). When the lever is pushed down by the user, a conventional toggle clamp 104 moves brake shoe 108. The brake shoe is preferably made out of compression molded, black natural rubber. When the lever is in the down position, the brake shoe frictionally engages and firmly presses against the outer surface of the rail member 54, thereby inhibiting its movement through the guide elements and allowing the user to recline in a fixed position. When a new position is desired, the user pulls up on the brake lever to release the brake, thereby allowing for further rotational movement of the chair.

Figure 9:
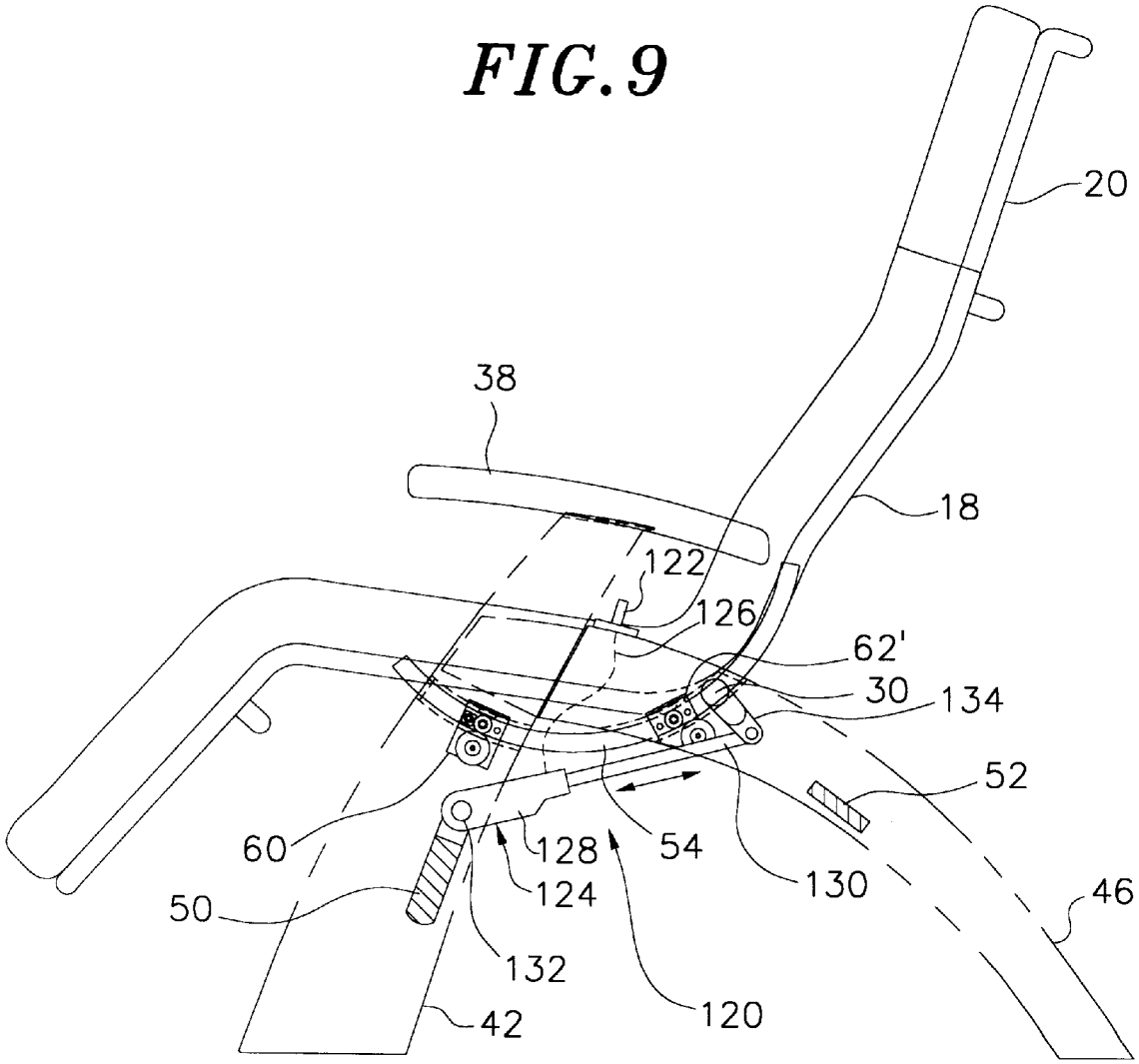
FIG. 9 is a side view of an alternate slidable lock brake assembly.

Referring to FIG. 9, an alternate slide lock braking assembly 120 which allows the user to fix the chair in a desired position includes a toggle switch 122, a linear mechanical slide lock 124, and a cable 126 connected between the switch and the lock for remotely actuating the lock. Toggle switch 122 is preferably attached to the left rear brace 46 of the leg assembly adjacent the front left stanchion 42 for ergonomically convenient actuation by the occupant. The slide lock 124 includes a hollow housing 128 and a cylindrical rod 130 adapted for axial movement back and forth through the housing. A suitable slide lock is manufactured by P. L. Porter Co., Woodland Hills, Calif. Details of the slide lock are disclosed in Porter et al., U.S. Pat. No. 5,441,129, the contents of which are hereby incorporated by reference. On one end of the slide lock, the slide lock housing 126 is securely fastened to front beam 50 of the support assembly 14 by a first clevis 132. At the opposite end of the slide lock, the axially moveable rod 130 is securely fastened to bow spanner 30 of the seat portion 12 by a second clevis 134 welded to the bow spanner. Since the slide lock is not integrated with a guide element, rear guide element 62' (FIGS. 7 and 7*a*) is used on both sides of the chair.

To recline in the chair, the occupant merely has to toggle the switch to the off position. In the off position, the axial rod moves freely through the housing, thereby allowing movement of the seat structure relative to the support assembly. Once a desired reclining position is located, the occupant merely has to move the switch to the on position. In the on position, the rod is grasped and locked in place, thereby preventing movement of the seat portion relative to the support assembly.

As is apparent from the foregoing description, the guide rail system and associated brake assemblies provide advantageous features not found in previous reclining chair designs based on the cradle or pendulum concepts. The present reclining chair provides smooth reclining motion while a user is sitting in the chair, and ergonomically convenient control for fixing the chair in a desired position.

Although the invention has been described in its presently contemplated best mode, various modifications, modes of operation and embodiments are possible, all within the ability and skill of those skilled in the art and without the exercise of further inventive activity. For example, the chair itself, including the seat structure and support assembly, can be made in a variety of shapes, sizes and designs to accommodate different users and to provide numerous different outward appearances. In some embodiments, curved channels to accommodate the rail members may not be necessary.

Similarly, the guide rail system disclosed is susceptible to various modifications and embodiments. For example, instead of attaching the rail members to the seat structure and the guide elements to the leg assemblies, the mounting locations of the rail members and guide elements can be transposed so the rail members are attached to the leg assemblies and the guide elements to the seat structure. In addition, the rail members need not be semi-circular, but may be elliptical, partially flat, or any other shape for reclining the chair in a desired manner. The rail members can also have a rectangular cross-section or any other cross section other than the tubular cross section shown. The guide elements need not be brackets, but may be made in any suitable manner for providing smooth, substantially friction-free sliding or rolling of the rails. The rotatable wheel on the guide element, for example, can be replaced with another nylon bumper. The brackets may be replaced by bearings, pads, or any other mechanism suitable for allowing guided motion of a rail member.

The brake assembly can be also be modified in numerous ways. For example, the levers or switches can be replaced with knobs or other actuating means. Although disclosed as a lever-actuated assembly or a slidable lock assembly, the brake may include, for example, simply a pin having a cushioned head and a body adapted for placement in slots on one or both of the rail members. In this embodiment, the pin body could be placed in a slot such that the pin head protrudes from the surface of the rail, thereby acting as a further rail stop for limiting movement of the rail members through the guide elements.

Accordingly, the present invention should in no way be limited to the preferred embodiment disclosed herein, but should be defined as set forth in the following claims.

What is claimed is:

1. A reclining chair comprising:

a seat structure for supporting an occupant, the seat structure including a frame;

a support assembly comprising a first side member and a second side member; and a rail guide system attached to the seat structure and support assembly for movably coupling the seat structure to the support assembly and for enabling the occupant to recline the chair between a substantially upright position and a substantially reclined position, the system including a pair of rail members arranged in a fixed positional relationship to one another and corresponding guide elements adapted for supporting and movably engaging the rail members; and at least one brake assembly for inhibiting movement of the seat structure relative to the support assembly, thereby allowing the occupant to maintain a desired reclining position;

wherein the guide element includes a roller bearing at least partially against a bottom portion of the rail member and a non-rotatable member bearing at least partially against a side portion of the rail member.

2. The reclining chair of claim 1, wherein each side member includes a stanchion and a brace, each brace attached to the stanchion for providing stable support for the chair.

3. The reclining chair of claim 1, wherein the guide elements are fixedly attached to the first and second side members.

4. The reclining chair of claim 3, wherein the side members include curved channels on the inside surface of each side member shaped to accommodate the rail members.

5. The reclining chair of claim 1, wherein the rail members are fixedly attached to the frame.

6. The reclining chair of claim 1, wherein the rail members include at least one rail stop for limiting movement of the rail members within the guide elements.

7. The reclining chair of claim 1, wherein the rail members have a tubular cross-section and a semi-circular shape.

8. The reclining chair of claim 1, wherein the guide element comprises:

a bracket;

said rotatable roller being attached to the bracket and adapted for engaging the rail member; and said non-rotatable member being attached to the bracket and adapted for slidably engaging the rail member.

9. The reclining chair of claim 8 wherein the rotatable roller has a flat face for engaging the rail member and the bumper is made of a polyester elastomeric material.

10. The reclining chair of claim 1, wherein the brake assembly comprises:

a lever;

a toggle clamp member having a first end and a second end, the first end coupled to the lever; and a a brake shoe coupled to the second end of the clamp member, the brake shoe positioned adjacent to one of the rail members, whereby, upon actuation of the lever, the brake shoe frictionally engages the rail member and prevents it from moving through the guide element.

11. The reclining chair of claim 1, wherein the brake assembly comprises a slide lock mechanism including a housing member attached to the support assembly, and a rod member attached to the seat portion, wherein the rod member moves linearly through the housing member.

12. The reclining chair of claim 1 wherein the seat structure includes an extended leg rest portion that enables the occupant's feet to be maintained above his or her heart when the chair is in a reclined position.

13. A reclining non-pendulum-based chair comprising:

a seat portion adapted to support a user sitting in the chair and to enable the user to recline backward in the chair, the seat portion including a body frame portion for supporting the user and a pair of rail members attached to opposite sides of the body frame;

a support assembly adapted to support the seat portion, the support assembly including first and second leg assemblies, each leg assembly having means for movably engaging one of the rail members, the engaging means comprising a roller, and a non-rotatable member, wherein the roller and non-the rotatable member are arranged to bear against a lower portion and a side portion of the rail member respectively for providing smooth travel of the rail member through the engaging means; and at least one brake means operable by the user for inhibiting movement of the rail member within the engaging means, thereby fixing a reclining position of the frame relative to the support assembly.

14. The reclining chair of claim 13, wherein the engaging means comprises a bracket, and wherein the non-rotatable member and roller are attached to the bracket and arranged to bear against the rail member for providing smooth travel of the rail member through the engaging means.

15. The reclining non-pendulum-based chair of claim 13, wherein the brake assembly comprises a brake lever having first and second operative positions, and a brake shoe coupled to a the brake lever, wherein the brake shoe is positioned adjacent the rail member when the lever is in the first position, and wherein the brake shoe frictionally engages and inhibits movement of the rail member when the lever is in the second position.

16. The reclining non-pendulum based chair of claim 13, wherein the brake assembly comprises a linear lock having a housing portion and a rod portion adapted for linear movement through the housing portion.

17. The reclining non-pendulum based chair of claim 16, wherein the housing portion is attached to the support assembly, and the rod portion is attached to the seat portion.

18. The reclining chair of claim 13 wherein the seat structure includes a header assembly, a body portion, and a leg support portion angled outwardly from the body portion, wherein the leg support portion facilitates maintenance of the user's feet above his or her heart when the chair is in a substantially reclined position.

19. The reclining chair of claim 13 wherein the seat portion is adapted to enable the user to recline backward in the chair while sitting in the chair.

20. A reclining chair comprising:

a support assembly, a seat portion; and coupling means, connected to the support assembly and seat portion, for movably coupling the seat portion to the support assembly, the means comprising a rail member and guide means comprising a roller for movably engaging at least a lower portion of the rail member and for supporting the rail member and a non-rotatable member for engaging at least a side portion of the rail member, wherein the weight of the seat structure is directly supported from points at which the guide means engages the rail member and wherein a user may recline backward in the chair to a position in which the user's feet are above his or her heart.

21. The reclining chair of claim 20, wherein the rail member is a curved tubular member fixedly attached to the seat structure, and the non-rotatable member comprises nylon.

22. The reclining chair of claim 20 further comprising brake means connected to the support assembly and the seat portion for inhibiting movement of the seat portion relative to the support structure.

23. The reclining chair of claim 22, wherein the brake means comprises means for frictionally engaging and hindering movement of the rail member relative to the guide means.

24. The reclining chair of claim 22, wherein the brake means comprises a linear mechanical lock connected between the support assembly and the seat portion.

* * * * *